US007951284B2

(12) United States Patent
Nakazawa et al.

(10) Patent No.: US 7,951,284 B2
(45) Date of Patent: May 31, 2011

(54) ELECTROLYSIS APPARATUS, ELECTROCHEMICAL REACTION MEMBRANE APPARATUS, POROUS ELECTRICAL CONDUCTOR, AND PRODUCTION METHOD THEREOF

(75) Inventors: Koji Nakazawa, Shioya-gun (JP); Masanori Okabe, Nerima-ku (JP); Masato Kita, Tokorozawa (JP); Kenji Taruya, Utsunomiya (JP); Tadashi Ogasawara, Nishinomiya (JP); Kazuomi Azuma, Kobe (JP); Takashi Onishi, Nishinomiya (JP)

(73) Assignees: Honda Motor Co., Ltd., Tokyo (JP); OSAKA Titanium Technologies Co., Ltd., Hyogo (JP)

( * ) Notice: Subject to any disclaimer, the term of this patent is extended or adjusted under 35 U.S.C. 154(b) by 1163 days.

(21) Appl. No.: 11/361,722

(22) Filed: Feb. 24, 2006

(65) Prior Publication Data

US 2006/0201800 A1 Sep. 14, 2006

(30) Foreign Application Priority Data

Feb. 25, 2005 (JP) ..... 2005-051354

(51) Int. Cl.
*B23H 3/00* (2006.01)

(52) U.S. Cl. ..... 205/640; 205/662; 216/53; 451/54

(58) Field of Classification Search ..... 204/252; 216/53; 451/54

See application file for complete search history.

(56) References Cited

U.S. PATENT DOCUMENTS

| | | | | |
|---|---|---|---|---|
| 2,114,072 | A * | 4/1938 | Cleveland | 492/37 |
| 3,759,747 | A * | 9/1973 | Schaer | 29/412 |
| 2005/0059219 | A1 * | 3/2005 | Tayanaka | 438/458 |

FOREIGN PATENT DOCUMENTS

| | | |
|---|---|---|
| JP | 2002-275676 | 9/2002 |
| JP | 2004-071456 | 3/2004 |

OTHER PUBLICATIONS

Translation of Japanese Document No. 2004-071456 to Onishi.*

* cited by examiner

*Primary Examiner* — Harry D Wilkins, III
*Assistant Examiner* — Zulmariam Mendez
(74) *Attorney, Agent, or Firm* — Nelson Mullins Riley & Scarborough LLP; Anthony A. Laurentano

(57) ABSTRACT

A water electrolysis apparatus includes a plurality of unit cells. A membrane electrode assembly of the unit cell includes an anode side power feeding element and a cathode side power feeding element stacked on an anode catalyst layer and a cathode catalyst layer on both surfaces of a solid polymer electrolyte membrane. A surface of the anode side power feeding element is subjected to a grinding process, and then, subjected to an etching process to form a smooth surface.

4 Claims, 9 Drawing Sheets

80

ELECTROLYSIS APPARATUS, ELECTROCHEMICAL REACTION MEMBRANE APPARATUS, POROUS ELECTRICAL CONDUCTOR, AND PRODUCTION METHOD THEREOF

BACKGROUND OF THE INVENTION

1. Field of the Invention

The present invention relates to an electrolysis apparatus having a porous electrical conductor for use as an electrolysis power feeding element, an electrochemical reaction membrane apparatus having a porous electrical conductor provided at least on one surface of a membrane used in an electrochemical reaction, and the porous electrical conductor used in these apparatuses. Further, the present invention relates to a method of producing the porous electrical conductor.

2. Description of the Related Art

In recent years, systems for supplying electrical power using hydrogen as a fuel have been proposed. For example, a polymer electrolyte fuel cell is known. The polymer electrolyte fuel cell includes a membrane electrode assembly and separators sandwiching the membrane electrode assembly. The membrane electrode assembly includes an anode, a cathode, and a solid polymer electrolyte membrane (ion exchange membrane) interposed between the anode and the cathode. Each of the anode and the cathode has an electrode catalyst layer and a gas diffusion layer.

In the fuel cell, a fuel gas such as a gas chiefly containing hydrogen (hereinafter also referred to as the "hydrogen-containing gas") is supplied to the anode. A gas chiefly containing oxygen or the air (hereinafter also referred to as the "oxygen-containing gas") is supplied to the cathode. The catalyst of the anode induces a chemical reaction of the fuel gas to split the hydrogen molecule into hydrogen ions and electrons. The hydrogen ions move toward the cathode through the electrolyte membrane, and the electrons flow through an external circuit to the cathode, creating DC electrical energy.

In general, a water electrolysis apparatus is adopted for producing hydrogen as a fuel. The water electrolysis apparatus uses a solid polymer electrolyte membrane for decomposing water to produce hydrogen (and oxygen). Electrode catalyst layers are provided on both surfaces of the solid polymer electrolyte membrane to form a membrane electrode assembly. Power feeding elements are provided on both surfaces of the membrane electrode assembly to form a unit of the water electrolysis apparatus. That is, the unit of the water electrolysis apparatus substantially has the same structure as the fuel cell.

After a plurality of units are stacked together, the voltage is applied to the opposite ends in the stacking direction. Water is supplied to the anode side power feeding element. Therefore, the water is decomposed into hydrogen ions (protons) at the anode of the membrane electrode assembly. The hydrogen ions pass through the solid polymer electrolyte membrane toward the cathode. The hydrogen ions combine with electrons to produce hydrogen. Further, at the anode, oxygen is produced together with the hydrogen ion. The oxygen and the redundant water are discharged from the unit.

For example, the power feeding element is made of a porous electrical conductive plate as disclosed in Japanese Laid-Open Patent Publication No. 2004-71456. In the conventional technique, as shown in FIG. 10, spherical gas atomized titanium powder 1 having a predetermined grain size is filled in a high density alumina sintering container 2 without any pressurization. Then, the spherical gas atomized titanium powder 1 filled in the container 2 is vacuum sintered without any pressurization to produce a sintered body of titanium powder having a plate shape. One surface of the sintered body of titanium powder is smoothened by a grinding process or a cutting process, and the one surface contacts a membrane electrode assembly (not shown).

In the conventional technique, for example, as shown in FIG. 11, when a surface 3*a* of a sintered body 3 of titanium powder is subjected to the grinding process or the cutting process, at the time of grinding or cutting, deformed portions 4 are likely to be formed. Thus, the porosity in the surface 3*a* of the sintered body 3 of titanium powder may be decreased undesirably. If the porosity in the surface 3*a* is decreased, the pressure loss in fluid is increased significantly. Therefore, at the time of water electrolysis, the oxygen produced on the surface of the anode electrolyte layer of the membrane electrode assembly cannot enter the anode side power feeding element. Consequently, the oxygen is retained between the anode catalyst layer and the power feeding element.

Thus, water supply becomes difficult. The water electrolysis is not performed desirably, and the moisture of the solid polymer electrolyte membrane is not maintained. The membrane resistance is increased, and the electrolysis voltage becomes high.

SUMMARY OF THE INVENTION

A main object of the present invention is to provide an electrolysis apparatus, an electrochemical reaction membrane apparatus, a porous electrical conductor, and a production method thereof which make it possible to smoothen the surface of the porous electrical conductor, and increase the porosity in the surface of the porous electrical conductor.

According to the present invention, an electrolysis apparatus comprises a porous electrical conductor for use as an electrolysis power feeding element. The porous electrical conductor is subjected to a grinding process, and then, subjected to an etching process to have a smooth surface.

Further, according to the present invention, an electrochemical reaction membrane apparatus comprises a porous electrical conductor provided at least on one surface of a membrane used in an electrochemical reaction. The porous electrical conductor is subjected to a grinding process, and then, subjected to an etching process to have a smooth surface.

Further, according to the present invention, a porous electrical conductor is used as a power feeding element of an electrolysis apparatus, and also used in an electrochemical reaction membrane apparatus. The porous electrical conductor is subjected to a grinding process, and then, subjected to an etching process to have a smooth surface.

Further, it is preferable that the porous electrical conductor is used as a water electrolysis power feeding element, and the smooth surface faces a membrane. In the structure, for example, it is possible to produce hydrogen efficiently by water electrolysis, and it is possible to suitably use the hydrogen as a fuel.

Further, it is preferable that the porous electrical conductor is a sintered body of spherical titanium particles. The formability of the material is excellent. In the structure, it is possible to form the smooth surface of the porous electrical conductor easily.

Further, it is preferable that the sintered body of spherical titanium particles has a porosity in the range of 10% to 50%. If the porosity is less than 10%, the fluid does not flow sufficiently, and if the porosity is more than 50%, the porous electrical conductor does not contact the membrane suitably.

In the present invention, after the surface of the porous electrical conductor is smoothened by the grinding process, it is possible to easily, and reliably eliminate deformation in the surface of the porous electrical conductor by the etching process. Thus, the surface of the porous electrical conductor is smoothened, and the porosity in the surface is increased desirably. Consequently, for example, the oxygen produced at the anode is discharged smoothly through the porous electrical conductor. Thus, the amount of the supplied water becomes sufficient, and the shortage of water supply does not occur.

Further, it is possible to achieve the desired porosity in the surface of the porous electrical conductor by the etching process. Therefore, it is possible to reduce the pressure loss, and reduce the pressure of the supplied water. Accordingly, the electrical power needed for the pump for supplying the water is reduced, and the energy efficiency in the system is improved.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
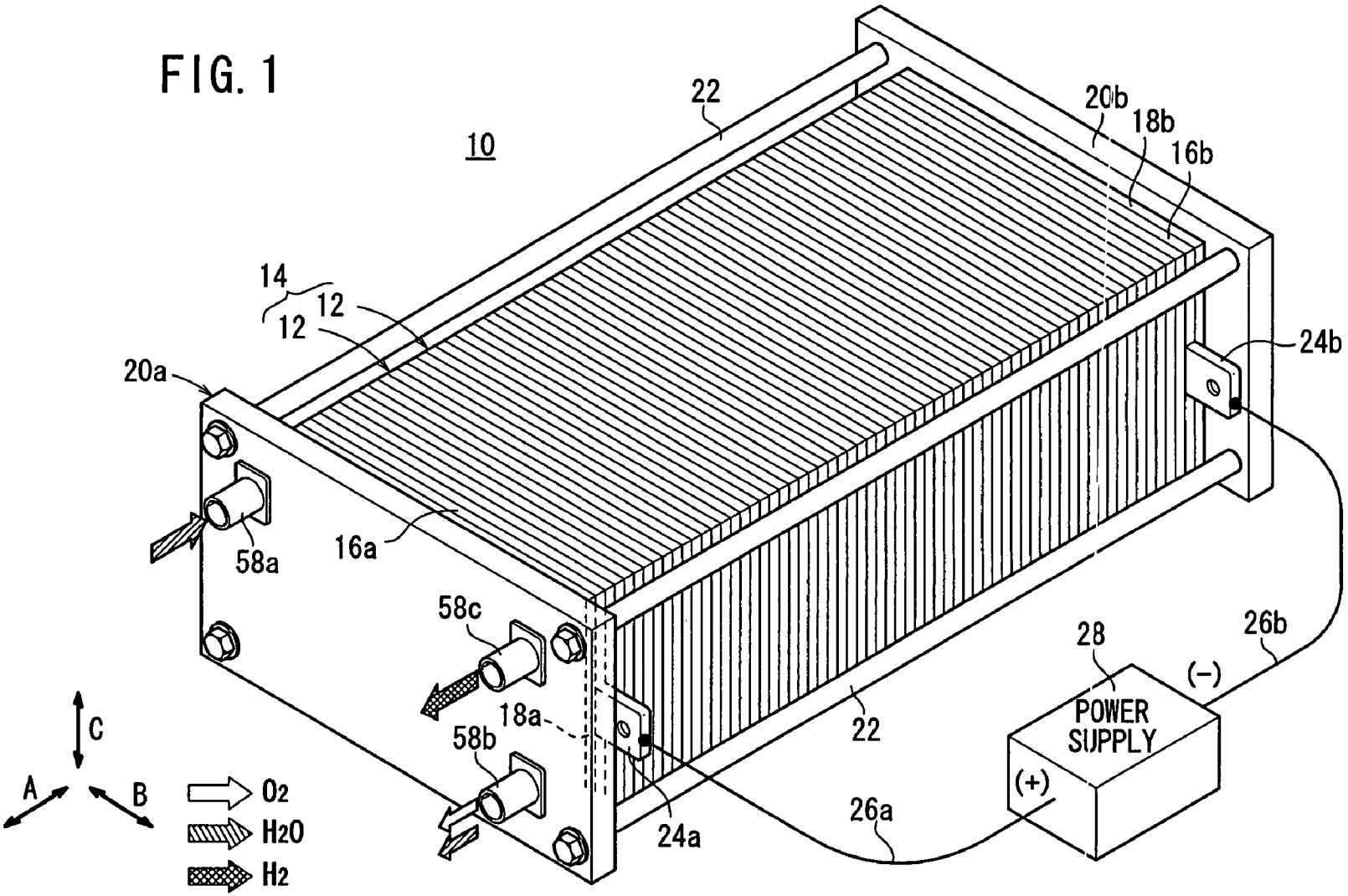
FIG. 1 is a perspective view showing a water electrolysis apparatus according to a first embodiment of the present invention.
Figure 2:
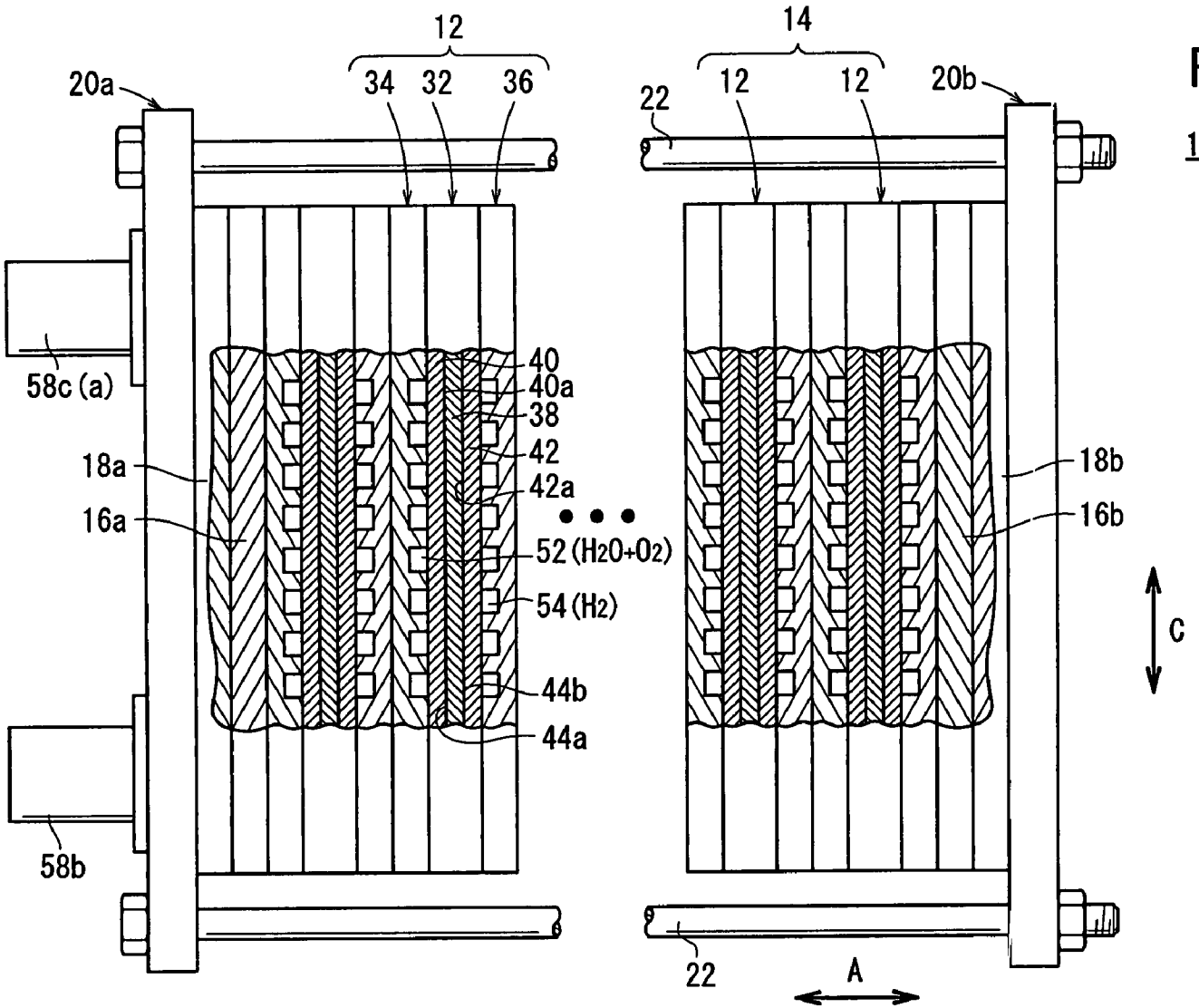
FIG. 2 is a partial cross sectional side view showing the water electrolysis apparatus.

FIG. 1 is a perspective view showing a water electrolysis apparatus (electrochemical reaction membrane apparatus) 10 according to a first embodiment of the present invention, and FIG. 2 is a partial cross sectional side view showing the water electrolysis apparatus 10.

The water electrolysis apparatus 10 includes a stack body 14 formed by stacking a plurality of unit cells 12 in a horizontal direction indicated by an arrow A. At one end of the stack body 14 in the stacking direction, a terminal plate 16*a* is provided. An insulating plate 18*a* is provided outside the terminal plate 16*a*. Further, an end plate 20*a* is provided outside the insulating plate 18*a*. Likewise, at the other end of the stack body 14 in the stacking direction, a terminal plate 16*b* is provided. An insulating plate 18*b* is provided outside the terminal plate 16*b*. Further, an end plate 20*b* is provided outside the insulating plate 18*b*.

For example, components of the water electrolysis apparatus 10 between the end plates 20*a*, 20*b* are tightened together by a plurality of tie rods 22 extending in the direction indicated by the arrow A. Alternatively, the water electrolysis apparatus 10 may be placed in a box-shaped casing (not shown) including the rectangular end plates 20*a*, 20*b*.

As shown in FIG. 1, terminals 24*a*, 24*b* protrude outwardly from sides of the terminal plates 16*a*, 16*b*, respectively. The terminals 24*a*, 24*b* are electrically connected to a power supply 28 through lines 26*a*, 26*b*. The terminal 24*a* on the anode side is connected to the positive (+) pole of the power supply 28, and the terminal 24*b* on the cathode side is connected to the negative (−) pole of the power supply 28.

Figure 3:
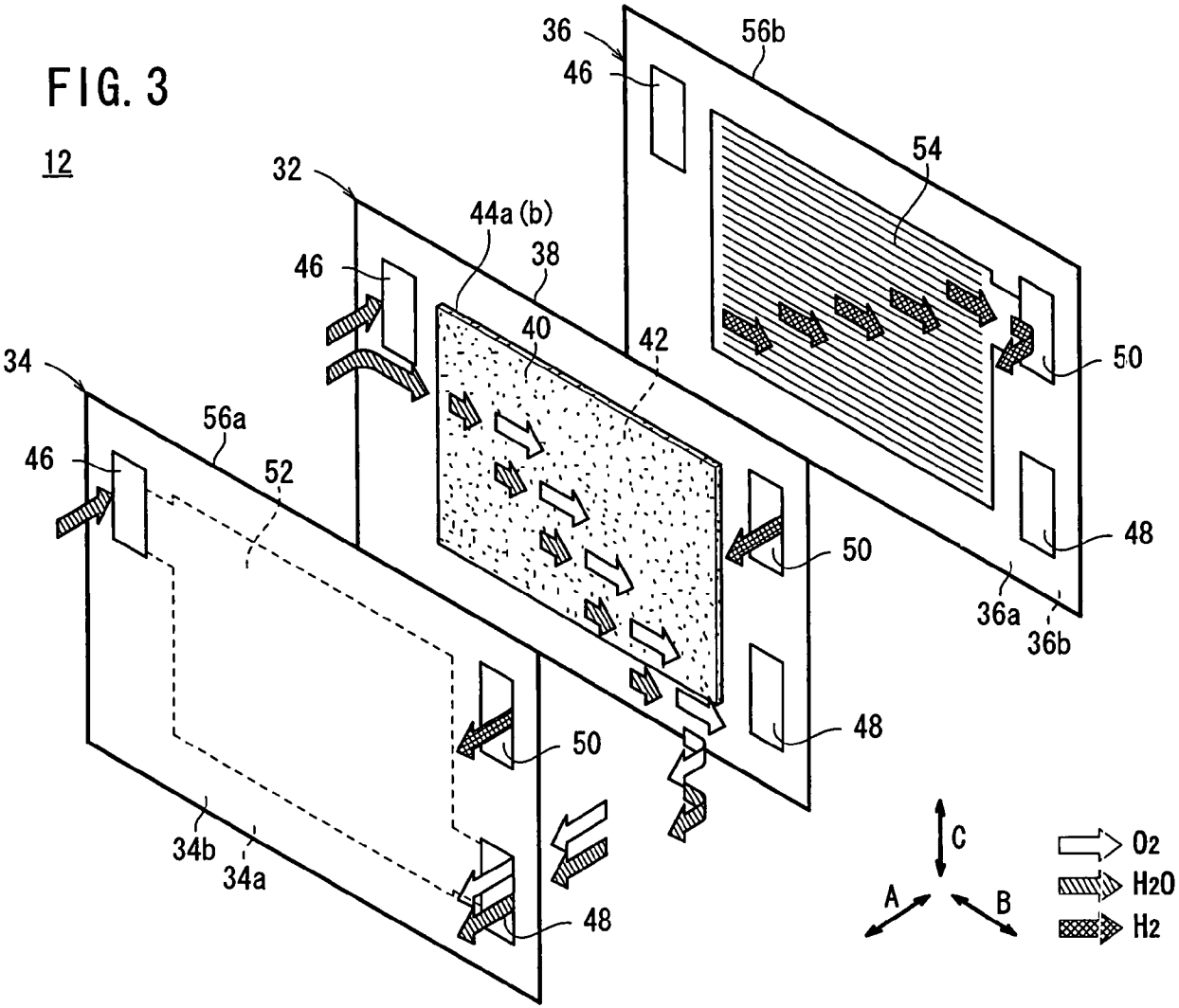
FIG. 3 is an exploded perspective view showing a unit cell of the water electrolysis apparatus.

As shown in FIGS. 2 and 3, the unit cell 12 includes a membrane electrode assembly 32 and an anode side separator 34 and a cathode side separator 36 sandwiching the membrane electrode assembly 32. For example, the anode side separator 34 and the cathode side separator 36 are carbon members. Alternatively, the anode side separator 34 and the cathode side separator 36 are steel plates, stainless steel plates, aluminum plates, or plated steel sheets. The anode side separator 34 and the cathode side separator 36 may be fabricated by press forming of metal plates having anti-corrosive surfaces formed by surface treatment or fabricated by anti-corrosive surface treatment after a cutting process.

The membrane electrode assembly 32 includes an anode side power feeding element (porous electrical conductor) 40, a cathode side power feeding element (porous electrical conductor) 42, and a solid polymer electrolyte membrane (electrolyte) 38 interposed between the anode side power feeding element 40 and the cathode side power feeding element 42. The anode side power feeding element 40 and the cathode side power feeding element 42 support the solid polymer electrolyte membrane 38. The solid polymer electrolyte membrane 38 is formed by impregnating a thin membrane of perfluorosulfonic acid with water, for example. An anode catalyst layer 44*a* and a cathode catalyst layer 44*b* are formed on both surfaces of the solid polymer electrolyte membrane 38. For example, an Ru (ruthenium) based catalyst is used for the anode catalyst layer 44*a*, and a platinum catalyst is used for the cathode catalyst layer 44*b*.

As described later, each of the anode side power feeding element 40 and the cathode side power feeding element 42 comprises a sintered body of spherical gas atomized titanium powder. The anode side power feeding element 40 and the cathode side power feeding element 42 have smooth surfaces 40*a*, 42*a*, which have been subjected to an etching process after a grinding process. The porosity of the anode side power feeding element 40 and the cathode side power feeding element 42 is preferably in the range of 10% to 50%, and more preferably in the range of 20% to 40%.

At one end of the unit cell 12 in a horizontal direction indicated by an arrow B in FIG. 3, a supply passage 46 for supplying water (pure water) is provided. The supply passage 46 extends through the unit cell 12 in the stacking direction indicated by the arrow A. At the other end of the unit cell 12 in the direction indicated by the arrow B, a discharge passage 48 for discharging oxygen produced in the reaction and water used in the reaction, and a hydrogen flow passage 50 for allowing hydrogen produced in the reaction to flow through the unit cell 12 are arranged vertically in a direction indicated by an arrow C. The discharge passage 48 and the hydrogen flow passage 50 extend through the unit cell 12 in the direction indicated by the arrow A.

Figure 4:
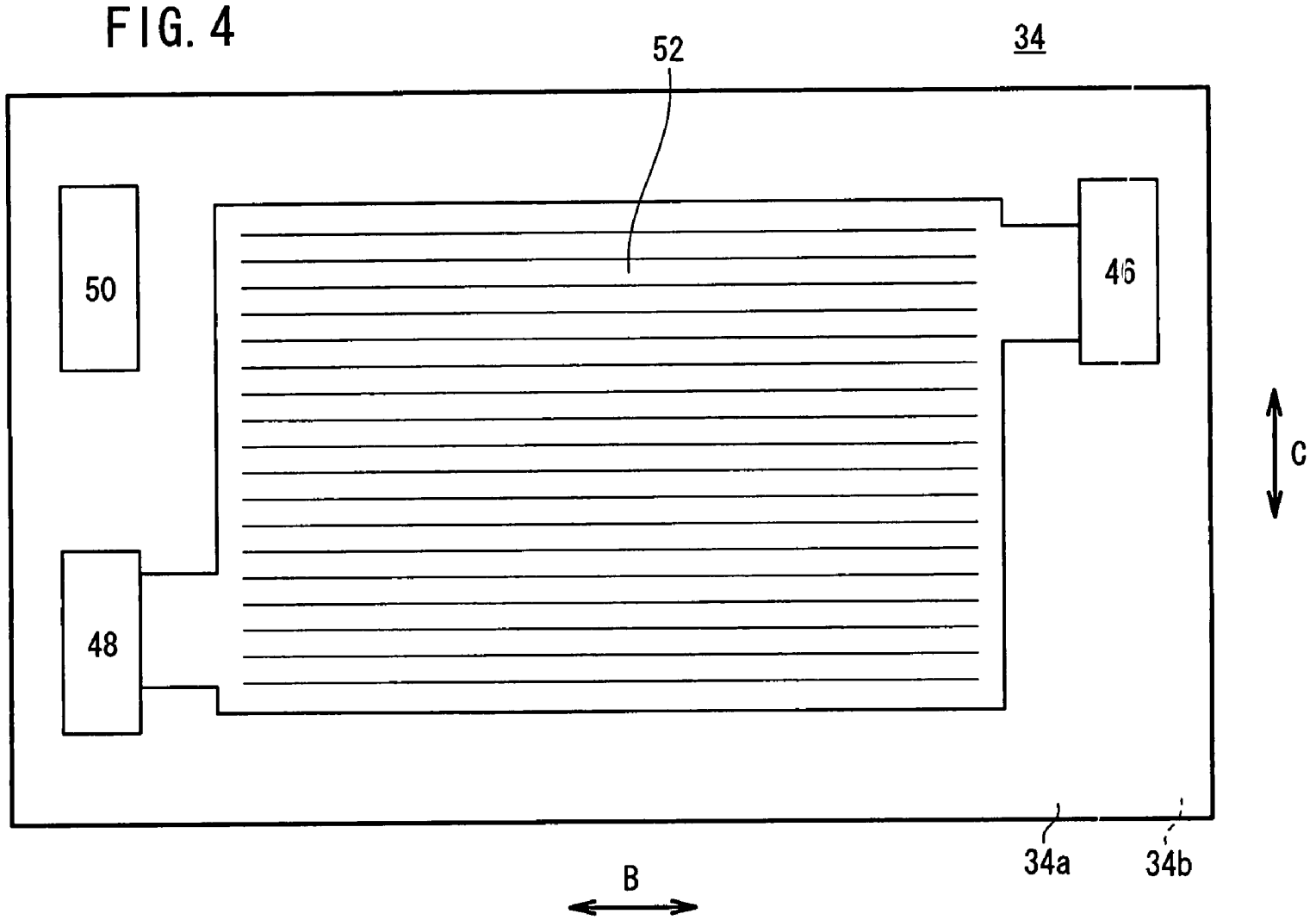
FIG. 4 is a front view showing an anode side separator of the unit cell.

As shown in FIG. 4, the anode side separator 34 has a first flow field 52 on its surface 34*a* facing the membrane electrode assembly 32. For example, the first flow field 52 comprises grooves extending in the direction indicated by the arrow B. The first flow field 52 is positioned in an area corresponding to the surface area of the anode side power feeding element 40, and connected to the supply passage 46 and the discharge passage 48. The other surface 34*b* of the anode side separator 34 has a planar shape.

As shown in FIG. 3, the cathode side separator 36 has a second flow field 54 on its surface 36*a* facing the membrane electrode assembly 32. For example, the second flow field 54 comprises grooves extending in the direction indicated by the arrow B. The second flow field 54 is positioned in an area corresponding to the surface area of the cathode side power feeding element 42, and connected to the hydrogen flow passage 50. The other surface 36*b* of the cathode side separator 36 has a planar shape.

A seal member 56*a* is formed integrally with the anode side separator 34, around the outer end of the anode side separator 34, and a seal member 56*b* is formed integrally with the cathode side separator 36, around the outer end of the cathode side separator 36. For example, the seal members 56*a*, 56*b* are made of seal material, cushion material or packing material such as EPDM (Ethylene Propylene diene terpolymer), NBR (Nitrile Butadiene Rubber), fluoro rubber, silicone rubber, fluoro silicone rubber, butyl rubber (Isobutene-Isoprene Rubber), natural rubber, styrene rubber, chloroprene rubber, or acrylic rubber.

As shown in FIG. 1, pipes 58*a*, 58*b*, 58*c* are provided at the end plate 20*a*. The pipes 58*a*, 58*b*, 58*c* are connected to the supply passage 46, the discharge passage 48, and the hydrogen flow passage 50.

Next, operation of producing the anode side power feeding element 40 of the membrane electrode assembly 32 will be described. The cathode side power feeding element 42 is produced in the same manner as the anode side power feeding element 40, and detailed description thereof will be omitted. Further, it should be noted that the cathode side power feeding element 42 is provided as necessary. That is, only the anode side power feeding element 40 may be provided.

Figure 5:
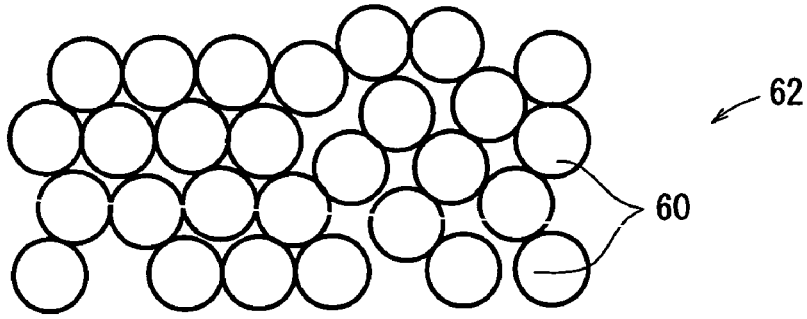
FIG. 5 is an enlarged view showing a sintered body of titanium powder.

As in the case of Japanese Laid-Open Patent Publication No. 2004-71456, as shown in FIG. 5, firstly, spherical gas atomized titanium powder (particles) 60 having a predetermined grain size is subjected to vacuum sintering without any pressurization to produce a sintered body 62 of titanium powder having a plate shape. The sintering temperature is lower than the melting point of titanium. Preferably, the sintering temperature is, e.g., in the range of 800° C. to 1300° C.

Figure 6:
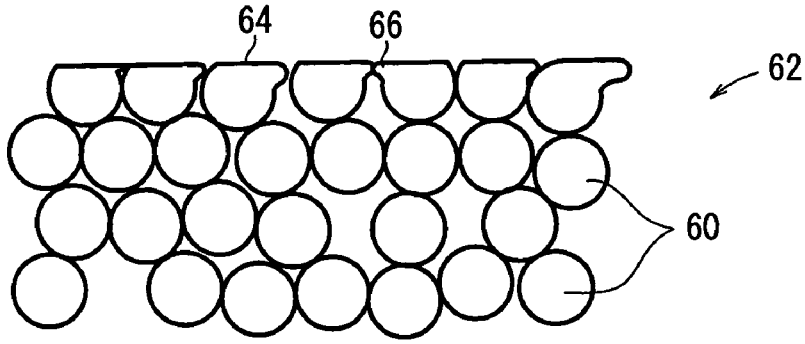
FIG. 6 is a partial enlarged view showing the state in which the sintered body of titanium powder is subjected to a grinding process.

Then, a surface of the sintered body 62 of titanium powder facing the solid polymer electrolyte membrane 38 is subjected to a grinding process to form a ground surface 64 (see FIG. 6). The ground surface 64 includes deformed portions 66. After the grinding process, the sintered body 62 of titanium powder is subjected to an etching process. Specifically, solution obtained by mixing 10 ml of nitric acid, 10 ml of 10% hydrofluoric acid, and 180 ml of pure water is used as etching solution, and the etching process is performed for an etching period of 90 seconds at room temperature.

Figure 7:
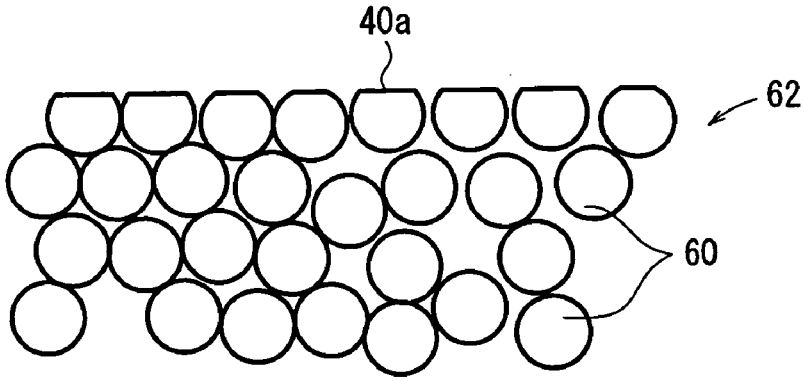
FIG. 7 is a partial enlarged view showing the state in which the sintered body of titanium powder is subjected to an etching process after the grinding process.

Thus, as shown in FIG. 7, the deformed portions 66 of the ground surface 64 are eliminated to form a smooth surface 40*a*. The smooth surface 40*a* is positioned on one side of the solid polymer electrolyte membrane 38. Further, a smooth surface 42*a* of the cathode side power feeding element 42 processed in the same manner is provided on the other side of the solid polymer electrolyte membrane 38 to form the membrane electrode assembly 32.

Next, operation of the water electrolysis apparatus 10 will be described below.

As shown in FIG. 1, water is supplied from the pipe 58*a* to the supply passage 46 of the water electrolysis apparatus 10, and the voltage is applied from the terminals 24*a*, 24*b* of the terminal plates 16*a*, 16*b* through the power supply 28 electrically connected to the terminals 24*a*, 24*b*. Thus, as shown in FIG. 3, in each of the unit cells 12, water is supplied from the supply passage 46 to the first flow field 52 formed between the anode side separator 34 and the anode side power feeding element 40.

Thus, the water is decomposed by electricity in the anode catalyst layer 44*a* to produce hydrogen ions, electrons, and oxygen. That is, the following anodic reaction is induced.

$H_2O \rightarrow 2H^+ + 2e^- + 1/2O_2$ (anodic reaction)

The hydrogen ions produced in the anodic reaction pass through the solid polymer electrolyte membrane 38 toward the cathode catalyst layer 44*b*, and combine with electrons to produce hydrogen. That is, the following cathodic reaction is induced.

$2H^+ + 2e^- \rightarrow H_2$ (cathodic reaction)

Thus, the hydrogen flows along the second flow field 54 formed between the cathode side separator 36 and the cathode side power feeding element 42. The hydrogen flows through the hydrogen flow passage 50 to the outside of the water electrolysis apparatus 10. The oxygen produced in the reaction and the redundant water flow through the first flow field 52, and are discharged to the outside through the discharge passage 48.

In the first embodiment, among the anode side power feeding element 40 and the cathode side power feeding element 42 of the membrane electrode assembly 32, at least in the anode side power feeding element 40, one surface of the sintered body 62 of titanium powder is subjected to the grinding process, and then, subjected to the etching process to form the smooth surface 40*a*. Therefore, in comparison with the case in which only the sintered body 62 of titanium powder is subjected to the grinding process, the porosity in the surface is increased desirably, and it becomes possible to desirably perform the water electrolysis process.

An experiment was conducted for comparison of electrolysis voltages at the time of electrolysis at high pressure in a first example according to the embodiment, a second example according to the embodiment, and a comparative example. In the first example, only the anode side power feeding element 40 was subjected to the surface grinding process, and then, subjected to the etching process. In the second example, both of the anode side power feeding element 40 and the cathode side power feeding element 42 were subjected to the surface grinding process, and then, subjected to the etching process. In the comparative example, both of the anode side power feeding element 40 and the cathode side power feeding element 42 were subjected to only the surface grinding process.

The etching process was performed under the etching condition in which solution obtained by mixing 10 ml of nitric acid, 10 ml of 10% hydrofluoric acid, and 180 ml of pure water was used as etching solution. The etching process was performed for an etching period of 90 seconds at room temperature. Further, the electrolysis process was performed under the high pressure electrolysis condition in which the hydrogen pressure produced on the side of the cathode catalyst layer 44*b* was 35 Mpa, and the temperature was 60° C.

As the solid polymer electrolyte membrane, Nafion, produced by DuPont was used. As the anode catalyst layer 44*a*, an RulrFeOx catalyst was used. As the cathode catalyst layer 44*b*, a platinum catalyst was used. The result is shown in FIG. 8.

Figure 8:
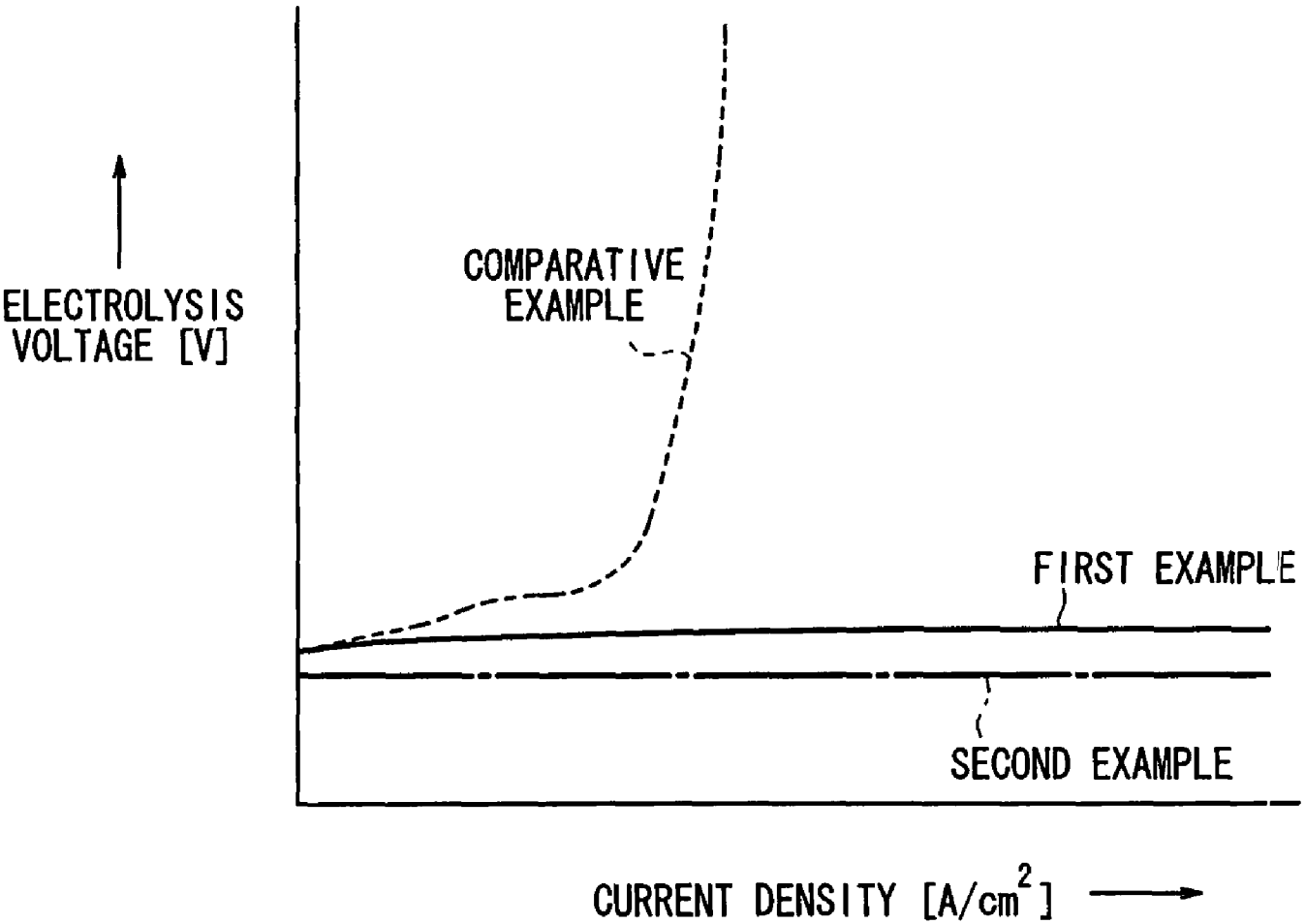
FIG. 8 is a graph showing the relationship between the electrolysis voltage and the current density in a first example and a second example according to the embodiment, and a comparative example.

As shown in FIG. 8, in the comparative example, since deformed portions were present in the ground surfaces of the anode side power feeding element 40 and the cathode side power feeding element 42, the porosity is significantly low. Therefore, as the current density increases, the oxygen produced at the surface of the anode catalyst layer 44*a* of the membrane electrode assembly 32 does not smoothly pass through the anode side power feeding element 40 to the first flow field 52 of the anode side separator 34, and the water is not sufficiently supplied to the anode catalyst layer 44*a*. Thus, in the comparative example, due to the shortage of water supply, the electrolysis voltage was increased significantly. Accordingly, the water electrolysis process became impossible.

In contrast, in the first example, the surface of the anode side power feeding element 40 is subjected to the grinding process, and then, subjected to the etching process. Thus, it becomes possible to desirably increase the porosity in the smooth surface 40*a*. Accordingly, even if the current density is increased, the oxygen produced in the anode catalyst layer 44*a* is smoothly discharged to the first flow field 52 through the anode side power feeding element 40, and the desired amount of water is supplied to the anode catalyst layer 44*a*. Accordingly, without any shortage of water supply, the desired water electrolysis process is performed advantageously.

In the second example, the same advantages as in the case of the first example can be obtained. Further, since the cathode side power feeding element 42 is also subjected to the grinding process, and then, subjected to the etching process to form the smooth surface 42*a*, it is possible to reduce the increase in the water electrolysis voltage even more reliably.

Figure 9:
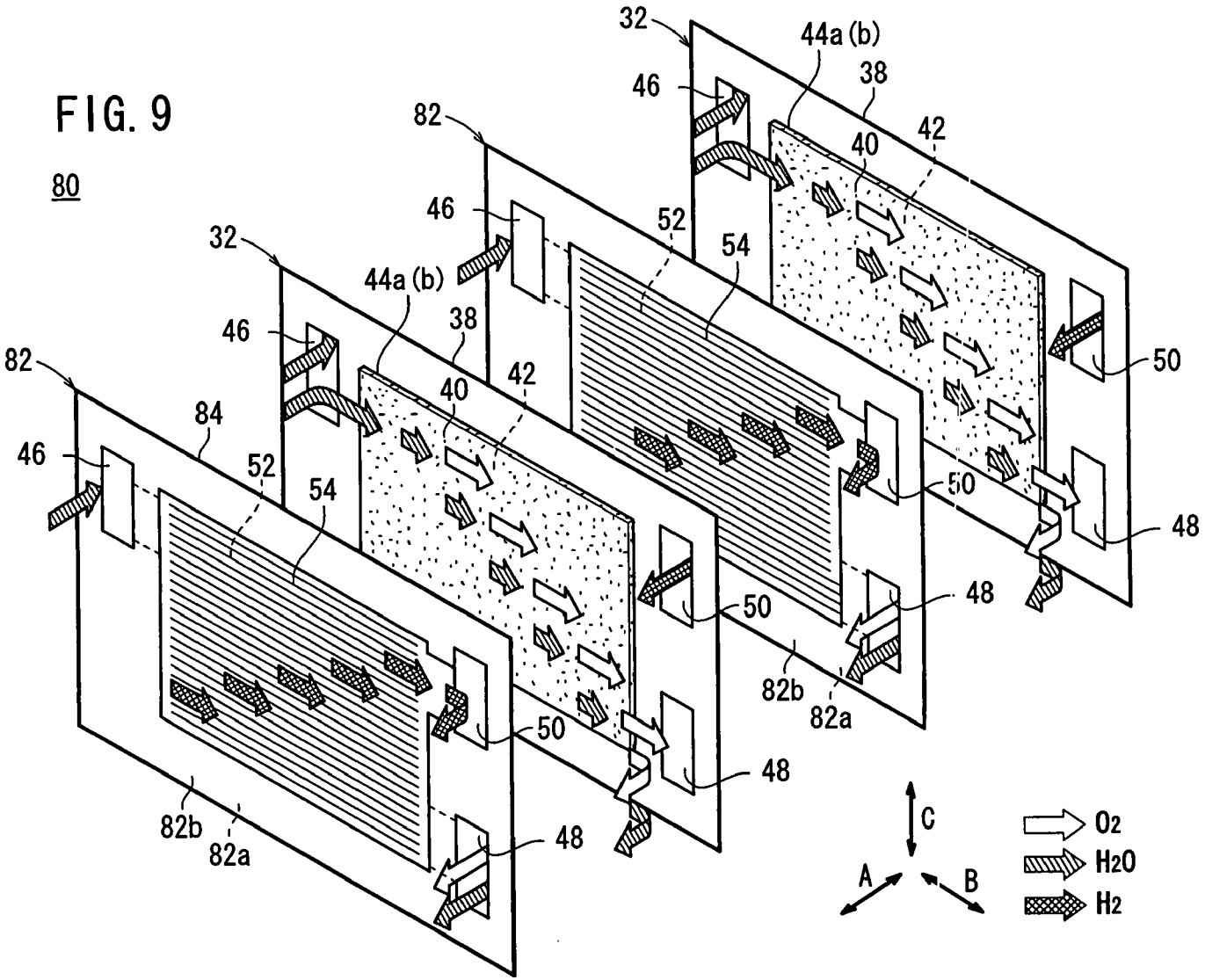
FIG. 9 is an enlarged perspective view showing a unit cell of a water electrolysis apparatus according to a second embodiment of the present invention.
Figure 10:
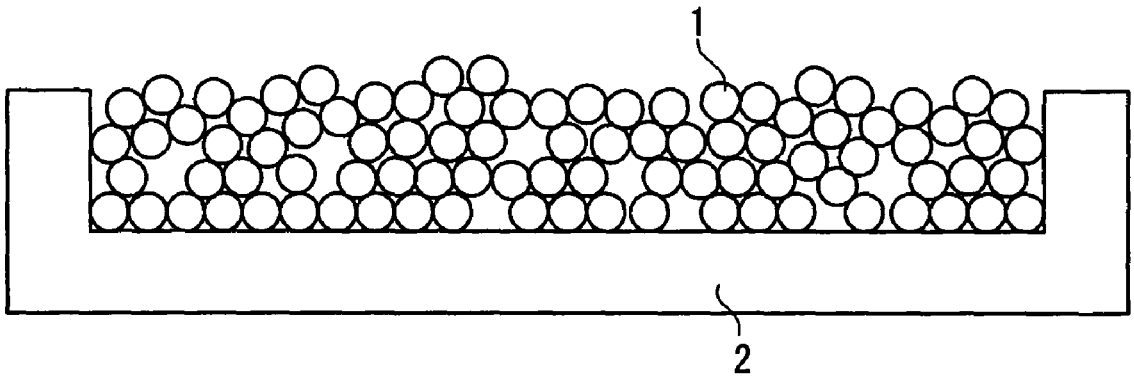
FIG. 10 PRIOR ART
FIG. 10 is a view showing the process of producing a conventional porous electrical conductive plate.
Figure 11:
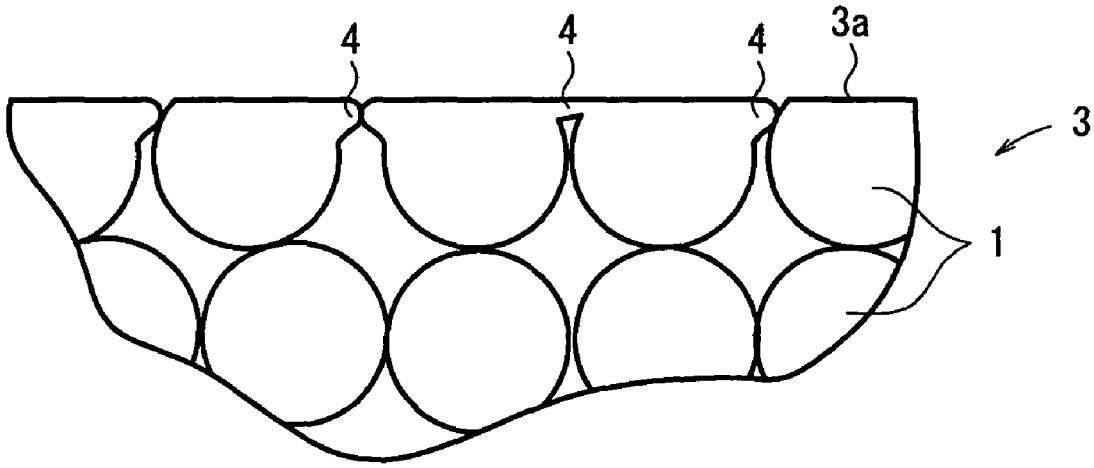
FIG. 11 PRIOR ART
FIG. 11 is a partial enlarged view showing the state in which a surface of the porous electrical conductive plate is subjected to a grinding process.

FIG. 9 is an exploded perspective view showing a unit cell 80 of a water electrolysis apparatus (electrochemical reaction membrane apparatus) according to a second embodiment of the present invention. The constituent elements that are identical to those of the unit cell 12 of the water electrolysis apparatus 10 according to the first embodiment are labeled with the same reference numeral, and description thereof will be omitted.

The unit cell 80 includes separators 82 sandwiching a membrane electrode assembly 32. In practice, a plurality of unit cells 80 are formed by stacking the separators 82 and the membrane electrode assemblies 32 alternately.

The separator 82 has a first flow field 52 on an anode surface 82*a* facing the anode side power feeding element 40, and a second flow field 54 on a cathode surface 82*b* facing the cathode side power feeding element 42. A seal member 84 is formed integrally with the separator 82, around the outer end of the separator 82.

In the second embodiment, the separators 82 and the membrane electrode assemblies 32 are stacked alternately. Therefore, the dimension in the stacking direction is effectively reduced advantageously. Further, the same advantages as in the case of the first embodiment can be obtained.

Though the first and second embodiments have been described in connection with the water electrolysis apparatus 10, the present invention is not limited in this respect. The present invention is applicable to various electrolysis apparatuses.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A method of producing a porous electrical conductor for use in an electrochemical reaction membrane apparatus comprising an electrochemical reaction membrane, comprising the steps of:

providing a sintered body of metal powder having a plate shape;

forming a ground surface by a grinding process on a side of said sintered body of metal powder that faces the electrochemical reaction membrane when the electrolysis apparatus is assembled; and removing deformation portions on said ground surface formed during the grinding process by an etching process after the grinding process to increase the porosity of said porous electrical conductor on the side facing the electrochemical reaction membrane.

2. A method according to claim 1, wherein said porous electrical conductor is used as a water electrolysis power feeding element, and said smooth surface faces an electrolyte membrane.

3. A method according to claim 1, wherein said porous electrical conductor is a sintered body of spherical titanium particles.

4. A method according to claim 3, wherein said sintered body of spherical titanium particles has a porosity in the range of 10% to 50%.

* * * * *